United States Patent [19]

Wakimizu

[11] Patent Number: 4,547,838

[45] Date of Patent: Oct. 15, 1985

[54] ELECTRIC LAMP ASSEMBLY WITH A MOLDED PLASTIC BASE

[75] Inventor: Yukio Wakimizu, Shizuoka, Japan

[73] Assignee: Koito Seisakusho Co., Ltd., Tokyo, Japan

[21] Appl. No.: 646,925

[22] Filed: Sep. 4, 1984

[30] Foreign Application Priority Data

Sep. 5, 1983 [JP] Japan ..... 58-137665[U]

[51] Int. Cl.[4] ..... F21M 3/30

[52] U.S. Cl. ..... 362/211; 362/267; 362/368; 362/296; 362/375; 362/308; 362/310; 313/318

[58] Field of Search ..... 362/226, 267, 211, 296, 362/308, 310, 368, 375; 313/318

[56] References Cited

U.S. PATENT DOCUMENTS

| | | | |
|---|---|---|---|
| 3,621,232 | 11/1971 | Hough | 362/267 |
| 3,818,215 | 6/1974 | Schmidt et al. | 362/226 |
| 4,019,045 | 4/1977 | Bassett | 362/226 |
| 4,119,877 | 10/1978 | Grewe et al. | 313/318 |
| 4,396,860 | 3/1983 | Hellwig et al. | 313/318 |
| 4,412,273 | 10/1983 | Helbig et al. | 362/211 |

FOREIGN PATENT DOCUMENTS 2732404 1/1978 Fed. Rep. of Germany ..... 362/267

*Primary Examiner*—Peter A. Nelson

*Attorney, Agent, or Firm*—Browdy and Neimark

[57] ABSTRACT

An electric lamp assembly comprises a lamp unit of generally conventional design, and a base subassembly coupled thereto both mechanically and electrically. The lamp unit may take the form of a halogen cycle lamp of the baseless type terminating in a pinch seal, with lead support wires extending outwardly therefrom. The base subassembly includes a metal made, dislike lamp holder apertured for the passage of the lamp unit seal therethrough and firmly engaging the same for holding the lamp unit. The lamp holder further engages one end of a metal made, tubular coupling, the other end of which is received with a sliding fit in one end of a substantially tubular base unit molded of plastics material. Extending through the coupling, the lead support wires are electrically and mechanically coupled as by welding to connectors mounted to a partition within the base unit. The plastic base unit is easier and less expensive to fabricate to close dimensionsal tolerances than the conventional metal base.

10 Claims, 10 Drawing Figures

ELECTRIC LAMP ASSEMBLY WITH A MOLDED PLASTIC BASE

BACKGROUND OF THE INVENTION

This invention relates to electric lamps in general and, in particular to an electric lamp assembly having a base subassembly molded mostly of plastics or synthetic resin material.

Electric lamps have been suggested in combination with a variety of base constructions for like or unlike applications. As far as the applicant is aware, the lamp bases of the type herein under consideration have so far been invariably of metal, usually fabricated by the drawing of sheet metal. A problem has existed with such metal made lamp bases. They are generally of such axial dimension in comparison with their diameter that their manufacture has required deep drawing. The conventional method of manufacture is objectionable by reason of a high percentage of defective products and the consequent waste of the material. An additional drawback is that the material for deep drawing must be a very ductile and expensive one. These disadvantages have added considerably to the manufacturing costs of the conventional lamp assemblies themselves.

SUMMARY OF THE INVENTION

The present invention solves the above problems by providing an improved electric lamp assembly having a base subassembly molded mostly of plastics material for higher dimensional accuracy, less manufacturing cost, and greater production. The improved lamp assembly is also notable for the ease with which the filament or filaments of the lamp unit can be aligned with respect to the base unit.

Stated briefly, the improved lamp assembly in accordance with the invention broadly comprises an electric lamp unit and a base subassembly which are coupled together both mechanically and electrically. The lamp unit comprises an envelope or bulb having a hermetic seal at one end, and relatively rigid main conductors anchored in and extending outwardly from the end seal of the envelope. The base subassembly comprises a metal made lamp holder engaging the lamp unit end seal for firmly holding the lamp unit, a metal made coupling, and a molded plastic base unit connected to the lamp holder via the coupling. The lamp holder is substantially in the shape of a disk, apertured for the passage of the lamp unit end seal therethrough. The coupling is substantially tubular in shape, loosely surrounding the main conductors projecting from the lamp unit end seal and having one end rigidly engaged with the lamp holder. Also substantially tubular in shape, the molded plastic base unit has one end adapted to receive the other end of the tubular coupling with a sliding fit, with the main conductors of the lamp unit extending into the base unit. Further included are connector means built into the base unit and electrically connected to the main conductors. The connections between main conductors and connector means are such that the main conductors are further mechanically coupled to the base unit to prevent the relative angular or axial displacement of the coupling and the base unit.

It is to be noted that the base unit of the base subassembly, which unit is the major component thereof, is of plastics material in accordance with the invention. Consequently the base unit lends itself to mass production by conventional plastics molding equipment to close dimensional tolerances and at materially reduced cost. It will also be appreciated that the plastics molding process yields a significantly less percentage of defective products than the conventional deep drawing process.

A further feature of the invention as summarized above is the fact that the tubular coupling makes a sliding fit with the base unit which also is substantially tubular in shape. Accordingly, before connecting the main conductors to the connector means, the coupling together with the lamp unit joined thereto via the lamp holder, and the base unit may be slidingly revolved one with respect to the other, in order that the filament or filaments of the lamp unit may be held in correct angular position relative to the base unit as the main conductors are subsequently coupled to the connector means as by welding.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

General

Figure 1:
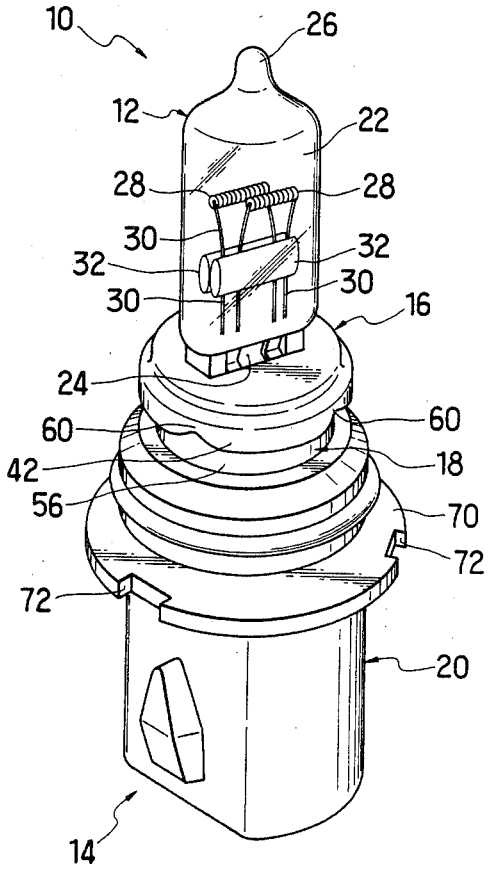
FIG. 1 is a perspective view of the electric lamp assembly constructed in accordance with the novel concepts of the present invention.
Figure 2:
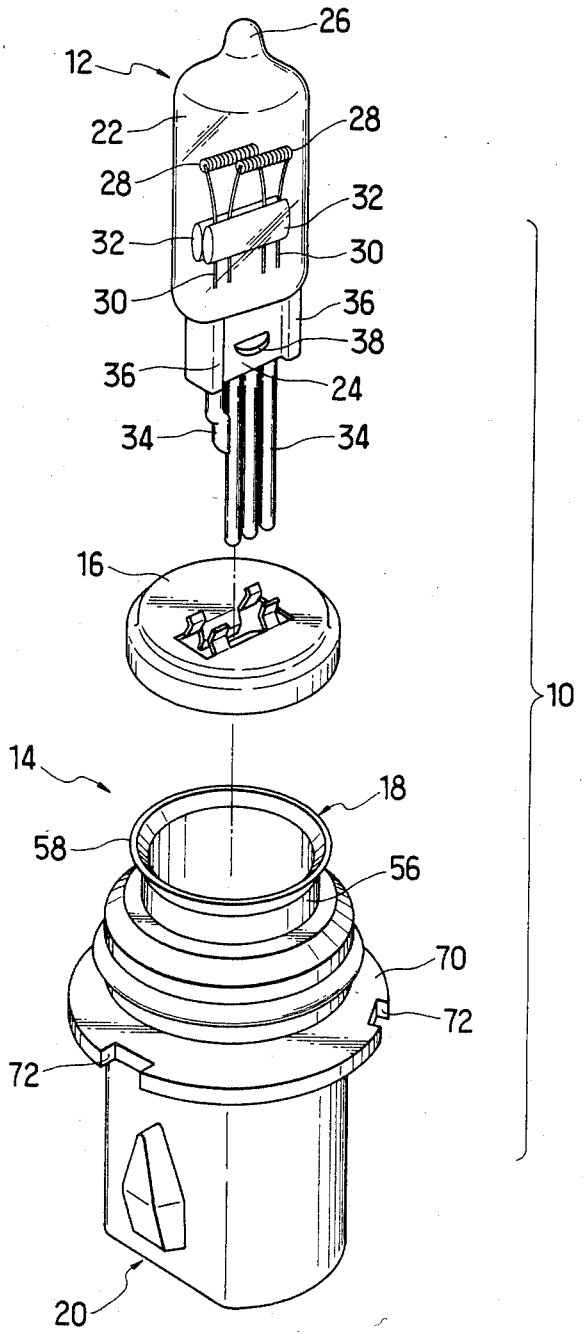
FIG. 2 is an exploded perspective view of the lamp assembly of FIG. 1, only with the coupling of the base subassembly shown engaged in the base unit.

The above drawings illustrate the present invention as embodied, by way of example only, in a halogen cycle, dual filament incandescent lamp assembly generally designated 10 in FIGS. 1 and 2. As will be seen from these figures, the exemplified lamp assembly 10 broadly comprises a baseless lamp unit 12 and a base subassembly 14. The lamp unit 12 can be of generally standard design.

The base subassembly 14 further resolves itself into a lamp holder 16, a coupling 18, and a base unit 20. Of these base subassembly components the lamp holder 16 and coupling 18 are both metal made whereas the base unit 20 is a plastic molding. As the names imply, the lamp holder 16 functions to firmly hold the lamp unit 12, and the coupling 18 to mechanically connect the lamp holder to the base unit 20. The base unit 20 serves, of course, as the base for the lamp unit 12, both mechanically and electrically.

Given hereafter is a more extensive discussion of the above recited lamp unit 12, lamp holder 16, coupling 18, and base unit 20, followed by that of the way these components are assembled into the lamp assembly 10. Such discussion of the individual components and the manner of their assemblage will be divided under several headings for the ease of understanding.

Lamp Unit

Figure 3:
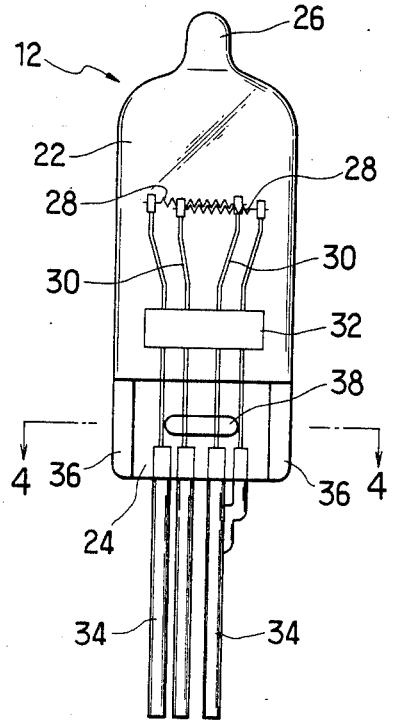
FIG. 3 is a slightly enlarged elevation of the lamp unit in the lamp assembly of FIG. 1.
Figure 4:
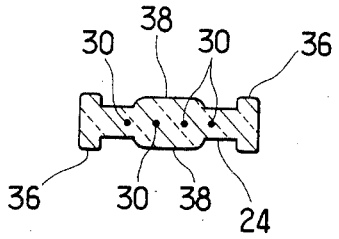
FIG. 4 is a section through the lamp unit, taken along the line 4—4 of FIG. 3 and showing in particular the cross sectional configuration of the pinch seal terminating one end of the lamp unit.

Reference is directed to FIGS. 3 and 4, in addition to FIGS. 1 and 2, for the detailed description of the lamp unit 12. Of the halogen cycle, dual filament type, the lamp unit 12 includes a vitreous envelope or bulb 22 terminating in a hermetic seal 24 at one end and in an exhaust tip 26 at another. The hermetic seal 24 is created by the pinching or pressing of the lamp envelope 22. As is well known, the halogen cycle lamp contains in its sealed envelope an inert fill gas and a measured amount of a halogen.

Received within the lamp envelope 22 are two coiled filaments 28 each mechanically supported by, and electrically connected to, a pair of lead in wires 30. The two pairs of lead in wires 30 are all anchored in and extend from the lamp envelope end seal 24. Also housed in the lamp envelope 22 are a pair of bridges 32 of suitable vitreous material which are disposed on opposite sides of the lead in wires 30 and are fused thereto to hold them in predetermined relative positions within the envelope and so electrically insulated from one another.

Main conductors or lead support wires 34 of greater diameter and rigidity than the lead in wires 30 are each anchored at one end in the lamp envelope end seal 24 and extend outwardly therefrom. All these main conductors 34 are electrically connected to the respective lead in wires 30 in the lamp envelope end seal 24. The rigidity of the main conductors 34 should optimumly be such that the lamp envelope 22 can be firmly supported by holding the distal ends of the main conductors by fingertips.

With particular reference to FIGS. 3 and 4 the end seal 24 of the lamp envelope 22 is substantially flat in shape. Preferably, and as shown, the end seal 24 is formed to include a pair of relatively raised longitudinal edges 36 along both sides thereof, so that the end seal is generally I shaped in cross section as best depicted in FIG. 4. However, only one such raised longitudinal edge could be formed along either side of the end seal 24. Further a boss or small projection 38 is formed on either, preferably each, surface of the end seal 24 and approximately centrally between the pair of longitudinal edges 36 thereof. The provision of these raised longitudinal edges 36 and bosses 38 on the end seal 24 is recommended because they make possible the more positive holding of the lamp unit 12 by the lamp holder 16, as will become apparent from the folowing detailed discussion of the lamp holder.

Lamp Holder

Figure 5:
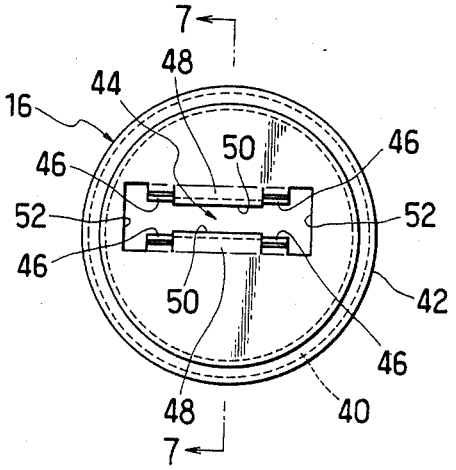
FIG. 5 is an enlarged plan view of the lamp holder of the base subassembly in the lamp assembly of FIG. 1.
Figure 6:
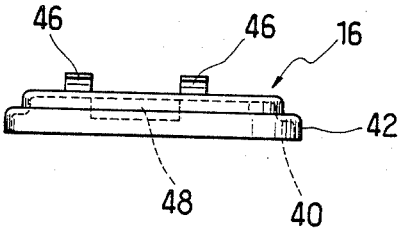
FIG. 6 is a side elevation of the lamp holder.
Figure 7:
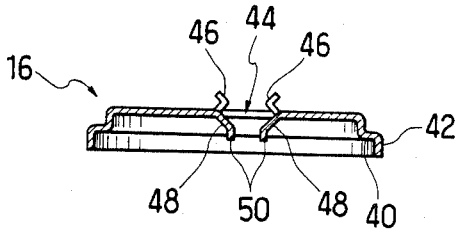
FIG. 7 is a section through the lamp holder, taken along the line 7—7 of FIG. 5.

A study of FIGS. 5 through 7 will make clear the configuration of the lamp holder 16. This lamp holder takes the form of a disk of sheet metal having considerable resiliency. The peripheral edge of the lamp holder 16 is stepped to provide an annular abutment 40, facing downwardly or toward the coupling 18, and an annular skirt 42 bent approximately right angularly from the abutment 40 toward the coupling. These abutment 40 and skirt 42 are both intended for positive engagement with the coupling 18, as will be later explained in further detail.

The lamp holder 16 has a slot or aperture 44 defined centrally therein to allow the end seal 24 of the lamp envelope 22 to extend therethrough. Along the opposite edges of the lamp holder 16 bounding the longitudinal sides of the slot 44 there are formed two opposed pairs of pawls 46 spaced from each other in the longitudinal direction of the slot, and another opposed pair of pawls 48 located between the first recited pairs of pawls. The first two pairs of pawls 46 will hereinafter be referred to as the outer pairs of pawls, and the second pair of pawls 48 as the inner pair of pawls, to facilitate description.

The two outer pairs of pawls 46 are each L shaped and are generally bent upwardly, or toward the lamp envelope 22, from the plane of the lamp holder 16. More specifically, as will be best understood from FIG. 7, each outer pair of pawls 46 are first inclined toward, and then away from, each other as they extend upwardly from the plane of the lamp holder 16. The inner pair of pawls 48, on the other hand, are generally bent downwardly, or toward the base unit 20, from the plane of the lamp holder, sloping toward each other as they extend downwardly. The tips 50 of this inner pair of pawls 48 are further bent into approximately parallel spaced relationship with each other. It will also be observed from FIG. 5 that the two outer pairs of pawls 46 are located away from the opposed edges 52 of the lamp holder 16 bounding the shorter sides of the slot 44, so that spaces are left for accommodating the pair of thicker longitudinal edges 36 of the lamp envelope end seal 24. Further, preferably, the spacings between each outer pair of pawls 46 and between the inner pair of pawls 48 are slightly less than the thickness of the lamp envelope end seal 24 when the latter is not inserted in the slot 44. As seen in a plan view as in FIG. 5, therefore, the lamp holder 16 defines an aperture approximately equal in shape to the cross section of the lamp envelope end seal 24 with its raised longitudinal edges 36.

Figure 8:
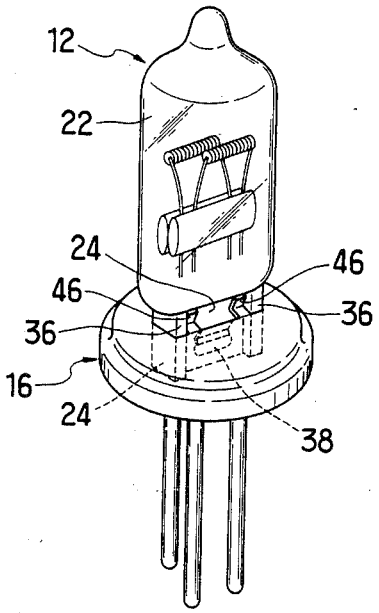
FIG. 8 shows in perspective the lamp unit of FIGS. 3 and 4 combined with the lamp holder of FIGS. 5 through 7, the lamp unit and the lamp holder being shown in their correct relative positions, with the lamp holder in engagement with the pinch seal of the lamp unit.
Figure 9:
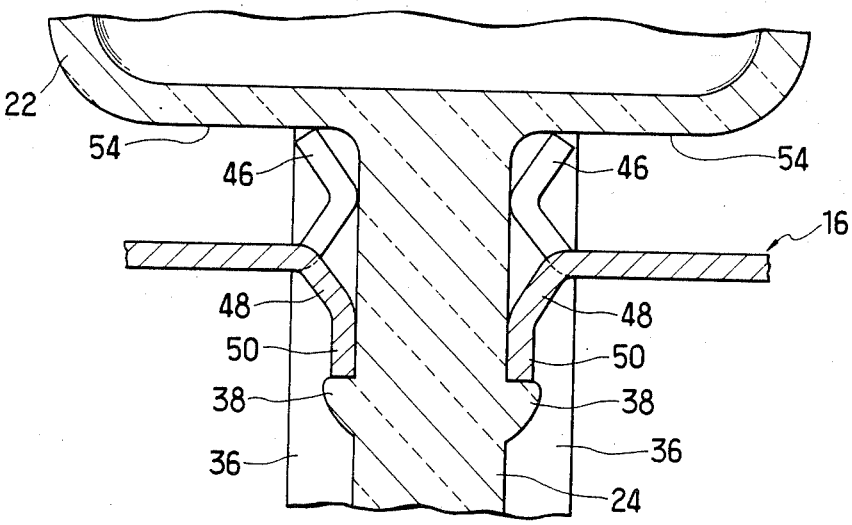
FIG. 9 is an enlarged, fragmentary axial section through the combination of the lamp unit and lamp holder of FIG. 8, taken along a plane normal to the generally flat pinch seal of the lamp unit, the view being explanatory of the way the lamp holder engages the pinch seal for positively holding the lamp unit.

FIGS. 8 and 9 illustrate the lamp unit 12 of FIGS. 3 and 4 and the lamp holder 16 of FIGS. 5 through 7 assembled together and held in their proper relative positions. For thus assembling the two components 12 and 16 the end seal 24 of the lamp unit 12 is inserted into and through the slot 44 in the lamp holder 16 until the two outer pairs of pawls 46 come into abutment against the bottom wall 54 of the lamp envelope 22 on the opposite sides of its end seal 24.

A consideration of FIG. 9 in particular will reveal that the outer pairs of pawls 46 are self biased to have their bends held against the opposite sides of the lamp unit end seal 24, in positions just inwardly of its raised longitudinal edges 36. Further the tips of these outer pairs of pawls 46 butt on the bottom 54 of the lamp envelope 22. Still further the outer pairs of pawls 46 are held sidewise against the pair of raised longitudinal edges 36 of the lamp unit end seal 24. The inner pair of pawls 48, on the other hand, are self biased to have their parallel tips 50 urged into abutment against the midportions of the opposite sides of the lamp unit end seal 24. These tips 50 further engage the bosses 38 formed centrally on the opposite sides of the lamp unit end seal 24.

As will have been seen from the foregoing, the lamp holder 16 has its three pairs of pawls 46 and 48 self biased into abutting engagement with the lamp unit 22 at a number of different points. These pawls also make positive engagement with the bottom 54 of the lamp envelope 22 and with the bosses 38 on the lamp envelope end seal 24. Further the two outer pairs of pawls 46 are snugly caught between and firmly held against the raised longitudinal edges 36 of the lamp unit end seal 24. It will therefore be appreciated that the lamp holder 16 can stably hold the lamp unit 12 against displacement or dislodgement in any direction.

Coupling

Figure 10:
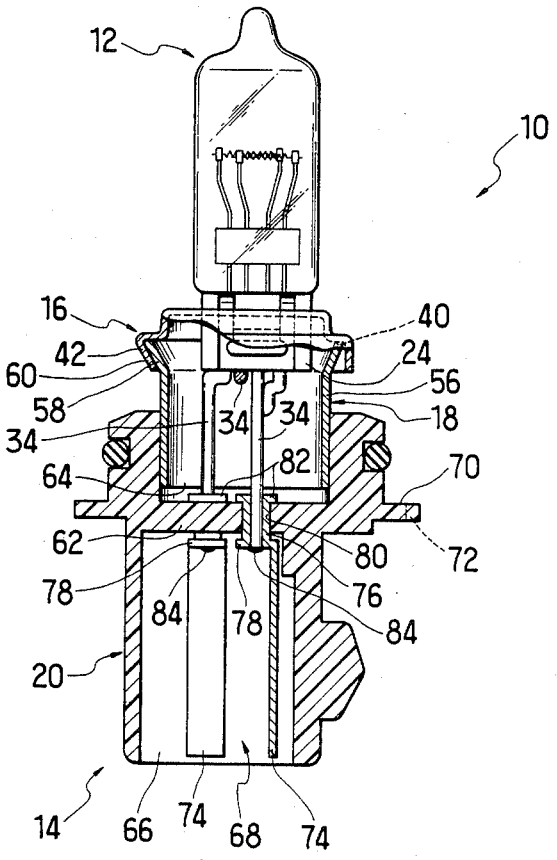
FIG. 10 shows, partly in elevation and partly in axial section, the lamp assembly of FIG. 1 in completed form, the view revealing in particular the internal configuration of the base subassembly.

The coupling 18 of the base subassembly 14 is best seen in FIGS. 2 and 10, the latter figure showing in particular the inner details of the base subassembly. The coupling 18 can simply be a relatively short, metal made tube 56, only with one end portion 58 thereof flared for positive engagement with the lamp holder 16.

The annular skirt 42 of the lamp holder 16 is sized to fit closely over the flared end portion 58 of the coupling 18. After receiving the flared end portion 58 of the coupling as best seen in FIG. 10, the lamp holder skirt 42 is to be pressed inwardly at several circumferentially spaced positions, as indicated at 60 in FIGS. 1 and 10, into positive engagement with the coupling end portion 58. Thus joined to the lamp holder 16, the coupling 18 loosely surrounds the main conductors 34 extending from the lamp envelope end seal 24.

Base Unit

The construction of the base unit 20 of the base subassembly 14 will be best understood by referring to FIGS. 1 or 2 and 10. The base unit 20 is substantially in the shape of a tube, integrally molded of plastics or synthetic resin material. The tubular base unit 20 is formed to include a partition 62, FIG. 10, dividing the interior thereof into a first portion 64 and a second portion 66. The first portion 64 receives the straight end portion, opposite to the flared end portion 58, of the coupling 18 with a sliding fit, whereas the second portion 66 accommodates connector means, generally designated 68 in FIG. 10, which may be thought of as part of the base subassembly 14. The base unit 20 is further formed to include a flange 70 around its outer surface. The flange 70 has a plurality of positioning notches or recesses 72 cut therein at circumferential spacings.

The connector means 68 comprises a plurality of blade-like connectors 74 each formed integral with a sleeve 76 via a flange 78 on one end of the sleeve. The sleeves 76 on the connectors 74 are inserted into and through respective bores 80 in the parition 62, from the second portion 66 toward first portion 64 of the base unit interior. Those ends of the sleeve 76 which project out of the bores 80 into the first base unit interior portion 64 are then clinched to provide flanges 82. These flanges coact with the aforesaid flanges 78 to lock the sleeves 76 against detachment from the base unit partition 62 in either direction. The main conductors 34 of the lamp unit 12 are inserted in the respective sleeves 76 for electrical and mechanical connection therewith.

Manner of Assemblage

For assembling the electric lamp assembly 10, the lamp unit 12 and lamp holder 16 may first be combined by inserting the end seal 24 of the lamp envelope 22 into and through the slot 44 in the lamp holder. The lamp holder 16 will properly hold the lamp unit 12 as its three pairs of pawls 46 and 48 are engaged between the bottom 54 of the lamp envelope 22 and the bosses 38 on the lamp envelope end seal 24 as in FIG. 9.

Then the flared end portion 58 of the coupling 18 may be fitted in the annular skirt 42 of the lamp holder 16, with the end of the coupling held neatly against the abutment 40 of the lamp holder. Then the skirt 42 of the lamp holder may be pressed inwardly at its several circumferentially spaced points 72 into close engagement with the flared end portion 58 of the coupling 18. Now the coupling 18 has been properly joined with the lamp holder 16 holding the lamp unit 12.

Then the straight end portion of the coupling 18 may be slid into the first interior portion 64 of the base unit 20. In so doing, the main conductors 34 of the lamp unit 12, partly projecting out of the coupling 18, may be inserted in the respective predetermined sleeves 76 of the connector means 68. Then the coupling 18 and the base unit 20 may be revolved relative to each other to an extent necessary to align the filaments 28 of the lamp unit 12 with respect to the positioning recesses 72 in the base unit flange 70. With the lamp filaments 28 thus brought to the correct angular position relative to the base unit 20, the main conductors 34 of the lamp unit 12 may then be soldered at 84 to the flanges 78 of the respective sleeves 76, thereby establishing electrical connection between main conductors 34 and connectors 74. Further, as the main conductors 34 are soldered to the connector means 68 as above, the lamp unit 12 and the base subassembly 14 are mechanically joined together, with the coupling 18 held against detachment from the base unit 20.

Conclusion

The base unit 20 with its flange 70, among other parts of the lamp assembly 10, must be fabricated to stringent dimensional tolerances for the precise mounting of the lamp assembly on a lamp body or reflector. Being of plastics material, the base unit can be easily molded to sufficiently close tolerances on a mass production basis and at reduced cost by conventional equipment. Compared with the deep drawing of metal, plastics molding is far more inexpensive, less likely to yield defective products, and involves less waste of material. The plastic base unit can therefore materially reduce the manufacturing cost of the complete lamp assembly 10.

In addition to the base unit 20 the base subassembly 14 comprises the metal made lamp holder 16 and metal made coupling 18. The interposition of these metal made parts between lamp unit 12 and base unit 14 serves not only to enhance the mechanical strength of the lamp assembly 10 but also to avoid direct contact of the plastic base unit with the lamp unit. There is accordingly no direct heat transfer from lamp unit 12 to base unit 20, so that there is little or no possibility of the base unit being ruined thermally in the use of the lamp assembly.

An additional feature of the invention is the sliding engagement of the coupling 18 with the base unit 20. This feature makes it possible to easily and precisely align the lamp filaments 28 with respect to the notched flange 70 on the base unit 20 by turning the coupling and base unit relative to each other before welding the main conductors 34 to the connector means 68.

It is to be understood that the lamp assembly disclosed herein, particularly the lamp unit thereof, is by way of example only and is not to impose limitations upon the invention, as the inventive concepts obviously find applications in other types of electric lamps. Various changes may therefore be made in the form, details, arrangements, and proportions of the parts without departing from the scope of the invention as expressed in the following claims.

I claim:

1. An electric lamp assembly comprising:

(a) a lamp unit comprising:

(1) an envelope having a hermetic seal at one end and containing a filament and lead in wires having portions anchored in the hermetic seal of the envelope; and (2) a plurality of relatively rigid main conductors anchored in the hermetic seal of the envelope and extending outwardly therefrom, the main conductors being electrically connected to the lead in wires in the hermetic seal of the envelope;

(b) a base subassembly comprising:

(1) a metal made lamp holder substantially in the shape of a disk apertured to allow the hermetic seal of the envelope of the lamp unit to pass therethrough, the lamp holder being further adapted to engage the hermetic seal of the envelope for firmly holding the lamp unit;

(2) a metal made coupling substantially in the shape of a tube loosely surrounding the main conductors of the lamp unit and having one end rigidly engaged with the lamp holder; and (c) a substantially tubular base unit comprising:

(1) an integral moding of plastics material having one end adapted to receive another end of the coupling with a sliding fit, the main conductors of the lamp unit extending into the base unit; and (2) connector means built into the base unit and electrically connected to the main conductors of the lamp unit, the connector means further serving to rigidly mechanically connect the main conductors to the base unit, whereby assembly of the lamp assembly is effected by assembling the lamp unit, the lamp holder and the coupling together to form a first subassembly, and then mounting the first subassembly to the base unit with the coupling slidably received in one end of said base unit.

2. The electric lamp assembly of claim 1 wherein the hermetic seal of the envelope of the lamp unit is substantially flat and is formed to include a pair of relatively raised longitudinal edges, and wherein the lamp holder of the base subassembly is fabricated of a resilient metal and comprises:

(a) a first set of pawls bent from the plane of the disklike lamp holder generally toward the envelope of the lamp unit into abutting engagement with the opposite sides of the hermetic seal of the envelope between the raised longitudinal edges thereof; and (b) a second set of pawls bent from the plane of the disklike lamp holder generally toward the base unit of the base subassembly into abutting engagement with the opposite sides of the hermetic seal of the envelope between the raised longitudinal edges thereof.

3. The electric lamp assembly of claim 2 wherein the hermetic seal of the envelope of the lamp unit is formed to include at least one boss on either side thereof and between the pair of longitudinal edges thereof, and wherein at least one of the second set of pawls of the lamp holder of the base subassembly is adapted to engage the boss on the hermetic seal.

4. The electric lamp assembly of claim 3 wherein the first set of pawls of the lamp holder of the base subassembly are further adapted to engage a bottom wall of the envelope of the lamp unit, whereby the lamp holder is caught between the bottom wall of the envelope and the boss on the hermetic seal of the envelope.

5. The electric lamp assembly of claim 1 wherein the lamp holder of the base subassembly is formed to include an annular peripheral skirt adapted to fit over the one end of the coupling of the base subassembly, the annular peripheral skirt of the lamp holder being further pressed inwardly into positive engagement with the coupling.

6. The electric lamp assembly of claim 5 wherein the one end of the coupling of the base subassembly is flared for positive engagement with the annular peripheral skirt of the lamp holder.

7. The electric lamp assembly of claim 1 wherein the base unit of the base subassembly is formed to include a partition dividing the interior of the base unit into a first portion for receiving the coupling of the base subassembly, and a second portion for accommodating the connector means of the base subassembly, the partition of the base unit being further adapted for the electrical and mechanical connection between the main conductors of the lamp unit and the connector means of the base subassembly.

8. The electric lamp assembly of claim 7 wherein the connector means of the base subassembly comprises:

(a) a plurality of connectors received in the second portion of the interior of the base unit;

(b) a sleeve formed integral with each connector of the connector means and received in a bore defined in the partition of the base unit, each sleeve being fitted over an end portion of one main conductor of the lamp unit; and (c) a pair of flanges formed on the opposite ends of each sleeve and engaged with the partition of the base unit for locking the sleeve against disengagement from the partition in either direction.

9. The electric lamp assembly of claim 8 wherein the main conductors of the lamp unit are joined to the respective sleeves of the connectors by means of a weld.

10. The electric lamp assembly of claim 1 wherein the base unit of the base subassembly is formed to include a flange having a plurality of recesses defined therein.

* * * * *